US009171660B2

(12) United States Patent
Ueno et al.

(10) Patent No.: US 9,171,660 B2
(45) Date of Patent: Oct. 27, 2015

(54) SUPERCONDUCTING COIL, SUPERCONDUCTING MAGNET, AND METHOD FOR MANUFACTURING SUPERCONDUCTING COIL

(75) Inventors: Eisaku Ueno, Osaka (JP); Takeshi Kato, Osaka (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 38 days.

(21) Appl. No.: 14/009,411

(22) PCT Filed: Apr. 24, 2012

(86) PCT No.: PCT/JP2012/060916
§ 371 (c)(1),
(2), (4) Date: Oct. 2, 2013

(87) PCT Pub. No.: WO2012/165085
PCT Pub. Date: Dec. 6, 2012

(65) Prior Publication Data

US 2014/0031235 A1 Jan. 30, 2014

(30) Foreign Application Priority Data

May 30, 2011 (JP) ..... 2011-120092

(51) Int. Cl.
*H01F 6/06* (2006.01)
*H01F 41/04* (2006.01)

(52) U.S. Cl.
CPC ..... *H01F 6/06* (2013.01); *H01F 6/065* (2013.01); *H01F 41/048* (2013.01); *Y10T 29/49014* (2015.01)

(58) Field of Classification Search
CPC ..... H01F 6/06; H01F 6/02; H01F 6/00; G01R 33/3815
See application file for complete search history.

(56) References Cited

U.S. PATENT DOCUMENTS

2010/0029487 A1 2/2010 Kobayashi

FOREIGN PATENT DOCUMENTS

| | | | |
|---|---|---|---|
| CN | 1959874 | A | 5/2007 |
| CN | 101542649 | A | 9/2009 |
| JP | S63-25905 | A | 2/1988 |
| JP | 2008-140930 | A | 6/2008 |
| JP | 2008-153372 | A | 7/2008 |
| JP | 2009-49033 | A | 3/2009 |
| JP | 2011-91290 | A | 5/2011 |

OTHER PUBLICATIONS

Translation of JP 63-25905 (patent published Feb. 3, 1988); pp. 1-12.*

* cited by examiner

*Primary Examiner* — Colleen Dunn
(74) *Attorney, Agent, or Firm* — Drinker Biddle & Reath LLP

(57) ABSTRACT

An inner circumferential portion is formed by winding one of first and second superconducting wires each having a band shape. An outer circumferential portion is formed by winding the other of the first and second superconducting wires around the inner circumferential portion. A welding portion joins the first and second superconducting wires to each other by welding between the inner circumferential portion and the outer circumferential portion. The first superconducting wire is higher in strength than the second superconducting wire. The second superconducting wire is smaller in thickness than the first superconducting wire.

7 Claims, 7 Drawing Sheets

SUPERCONDUCTING COIL, SUPERCONDUCTING MAGNET, AND METHOD FOR MANUFACTURING SUPERCONDUCTING COIL

TECHNICAL FIELD

The present invention relates to a superconducting coil, a superconducting magnet, and a method for manufacturing a superconducting coil.

BACKGROUND ART

Japanese Patent Laying-Open No. 2008-153372 discloses a superconducting coil formed by winding a bismuth-based superconducting wire having a band shape. The superconducting wire is wound to form a racetrack shape having a straight portion and an arc portion.

CITATION LIST

Patent Document

PTD 1: Japanese Patent Laying-Open No. 2008-153372

SUMMARY OF INVENTION

Technical Problem

If excessive stress is applied to a superconducting wire during manufacturing or use of a superconducting coil, the superconducting wire is damaged and reliability of the superconducting coil may lower. For example, in winding a superconducting wire around a core during manufacturing of a superconducting coil, a portion of start of winding, that is, an inner circumferential portion, is prone to damage because it is smaller in radius of curvature than a portion of end of winding. In order to avoid such damage, strength of the superconducting wire should only be increased by increasing a thickness thereof. Normally, however, a superconducting coil should have a prescribed number of turns, and in that case, a greater thickness of a superconducting wire leads to increase in size of a superconducting coil. Thus, in a superconducting coil having a prescribed number of turns, reliability of a superconducting coil and reduction in size thereof has had trade-off relation.

Then, an object of the present invention is to provide a superconducting coil, a superconducting magnet, and a method for manufacturing a superconducting coil, which is capable of achieving reduction in size while ensuring high reliability in a superconducting coil having a prescribed number of turns.

Solution to Problem

A superconducting coil according to the present invention has an oxide superconductor, and has an inner circumferential portion, an outer circumferential portion, and a welding portion. The inner circumferential portion is formed by winding one of first and second superconducting wires each having a band shape. The outer circumferential portion is formed by winding the other of the first and second superconducting wires around the inner circumferential portion. The welding portion joins the first and second superconducting wires to each other by welding between the inner circumferential portion and the outer circumferential portion. The first superconducting wire is higher in strength than the second superconducting wire. The second superconducting wire is smaller in thickness than the first superconducting wire.

According to the superconducting coil of the present invention, of the inner circumferential portion and the outer circumferential portion, one requiring higher strength can be formed from the first superconducting wire, while one requiring lower strength can be formed from the second superconducting wire. Namely, a portion requiring higher strength can be formed from a superconducting wire higher in strength, while a portion requiring lower strength can be formed from a superconducting wire smaller in thickness. Therefore, a superconducting coil having a prescribed number of turns can achieve reduction in size while ensuring high reliability.

The inner circumferential portion may be formed by winding the first superconducting wire. In addition, the outer circumferential portion may be formed by winding the second superconducting wire.

Thus, the inner circumferential portion wound with a diameter of curvature smaller than that of the outer circumferential portion is formed from a superconducting wire higher in strength. Therefore, damage of a superconducting wire caused by a small diameter of curvature can be suppressed.

The first and second superconducting wires joined to each other by the welding portion may be wound to form a racetrack shape having a straight portion and a curved portion. In addition, at least a part of the welding portion may be located at the curved portion.

Thus, at least a part of the welding portion is located at the curved portion during manufacturing of the superconducting coil, so that winding with less loosening is achieved. Therefore, since a position of the welding portion is stabilized, the welding portion is less likely to displace during winding. Thus, damage of the second superconducting wire, that is, a superconducting wire smaller in thickness, at an end portion of the welding portion due to displacement of the welding portion can be prevented.

The welding portion may be located only at the curved portion.

If the welding portion is located across the straight portion and the curved portion, a portion of the welding portion located at the curved portion is less likely to displace as described above, whereas a portion located at the straight portion is likely to displace. Consequently, the welding portion is likely to deteriorate at a boundary between the straight portion and the curved portion. Such deterioration can be prevented by the welding portion located only at the curved portion.

In the superconducting coil above, the welding portion may have a length not shorter than 2 cm.

Thus, the welding portion can have electrical resistance of a value sufficiently low in terms of practical use.

In the superconducting coil above, there may be a height difference between the inner circumferential portion and the outer circumferential portion because a width of the band shape of the first superconducting wire is greater than a width of the band shape of the second superconducting wire. In this case, the superconducting coil may have a spacer portion burying the height difference.

Thus, a gap attributed to the height difference between the inner circumferential portion and the outer circumferential portion can be buried. Therefore, lowering in heat conduction due to this gap can be suppressed.

A superconducting magnet according to the present invention has the superconducting coil described above, a heat insulating container, and a power supply. The heat insulating container accommodates the superconducting coil. The power supply is connected to the superconducting coil.

According to the superconducting magnet of the present invention, of the inner circumferential portion and the outer circumferential portion of the superconducting coil, one requiring higher strength can be formed from the first superconducting wire, while one requiring lower strength can be formed from the second superconducting wire. Namely, a portion requiring higher strength can be formed from a superconducting wire higher in strength, while a portion requiring lower strength can be formed from a superconducting wire smaller in thickness. Therefore, in a superconducting magnet having a superconducting coil having a prescribed number of turns, while strength required of the superconducting coil can be ensured, reduction in size of the superconducting coil can be achieved by using a superconducting wire smaller in thickness. Therefore, a superconducting magnet can be reduced in size while reliability of the superconducting magnet is ensured.

A method for manufacturing a superconducting coil according to the present invention is a method for manufacturing a superconducting coil having an oxide superconductor, and has the following steps.

An inner circumferential portion is formed by winding one of first and second superconducting wires each having a band shape. After the inner circumferential portion is formed, the first and second superconducting wires are joined to each other by welding. After the first and second superconducting wires are joined to each other, an outer circumferential portion is formed by winding the other of the first and second superconducting wires around the inner circumferential portion. The first superconducting wire is higher in strength than the second superconducting wire. The second superconducting wire is smaller in thickness than the first superconducting wire.

According to the method for manufacturing a superconducting coil of the present invention, the welding portion is formed after the inner circumferential portion is formed. Therefore, damage of a superconducting wire due to the welding portion is not caused during formation of the inner circumferential portion.

Advantageous Effects of Invention

As described above, according to the present invention, in a superconducting coil having a prescribed number of turns, reduction in size of a superconducting coil can be achieved while high reliability is ensured.

DESCRIPTION OF EMBODIMENTS

Figure 1:
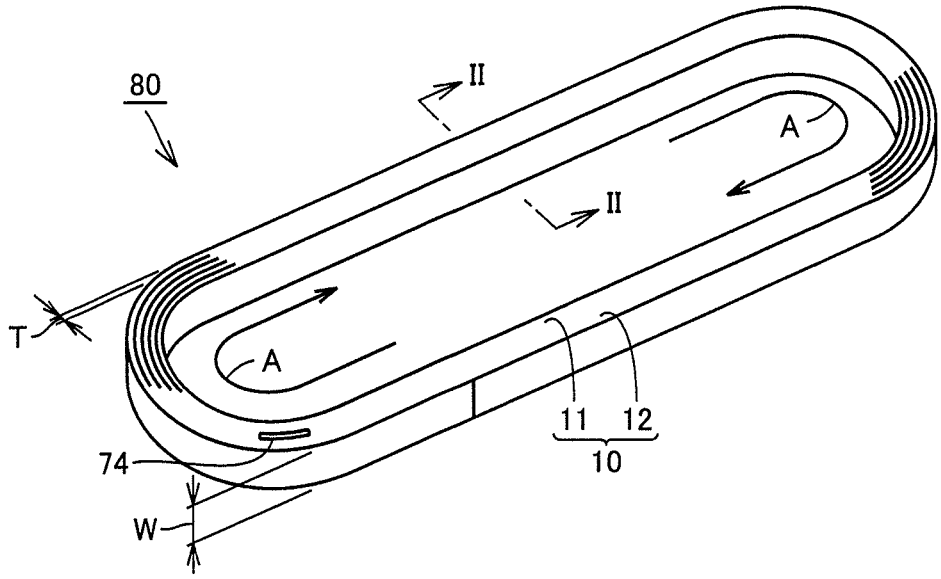
FIG. 1 is a perspective view schematically showing a construction of a superconducting coil in a first embodiment of the present invention.

An embodiment of the present invention will be described hereinafter with reference to the drawings. It is noted that the same or corresponding elements in the drawings below have the same reference characters allotted and description thereof will not be repeated.

First Embodiment

Figure 4:
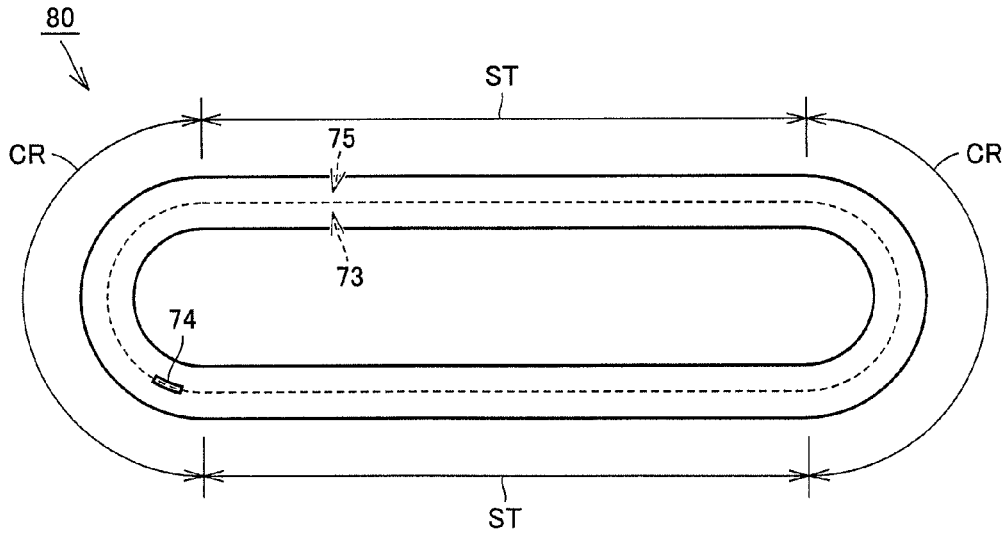
FIG. 4 is a diagram of a schematic two-dimensional layout of the superconducting coil in FIG. 1.

Referring mainly to FIGS. 1 to 4, a superconducting coil 80 in the present embodiment is formed by winding a superconducting wire 10 made of an oxide superconductor as shown with an arrow A (FIG. 1). Specifically, superconducting wire 10 is wound to form a racetrack shape having a straight portion ST and a curved portion CR (FIG. 4).

Superconducting wire 10 is formed by joint of first and second superconducting wires 11, 12 each having a band shape to each other with a welding portion 74. It is noted that "welding" herein is a concept encompassing "soldering". Therefore, the "welding portion" may be a "soldering portion".

Preferably, at least a part of welding portion 74 is located at curved portion CR. More preferably, welding portion 74 is located only at curved portion CR.

Welding portion 74 joins first and second superconducting wires 11, 12 to each other over a joint length SL (FIG. 3) in a longitudinal direction. Welding portion 74 is made, for example, of solder. Preferably, joint length SL, that is, a length of welding portion 74, is not shorter than 2 cm, and in this case, connection resistance can be not higher than approximately 100 nΩ. It is noted that a notch may be provided at an end of at least any of first and second superconducting wires 11, 12 over a notch length TL shorter than joint length SL.

Superconducting coil 80 has an inner circumferential portion 73 and an outer circumferential portion 75 in a two-dimensional layout as shown in FIG. 4. Inner circumferential portion 73 is formed by winding first superconducting wire 11. Outer circumferential portion 75 is formed by winding second superconducting wire 12 around inner circumferential portion 73. Welding portion 74 joins first and second superconducting wires 11, 12 to each other by welding between inner circumferential portion 73 and outer circumferential portion 75, such that inner circumferential portion 73 and outer circumferential portion 75 are connected electrically in series to each other.

Figure 5:
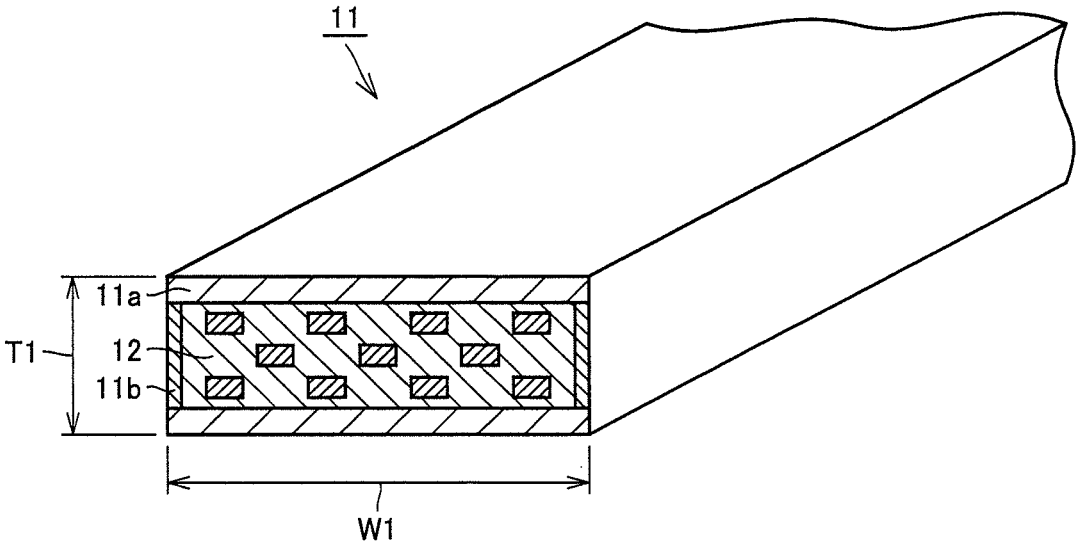
FIG. 5 is a perspective cross-sectional view of a first superconducting wire used in the superconducting coil in FIG. 1.
Figure 6:
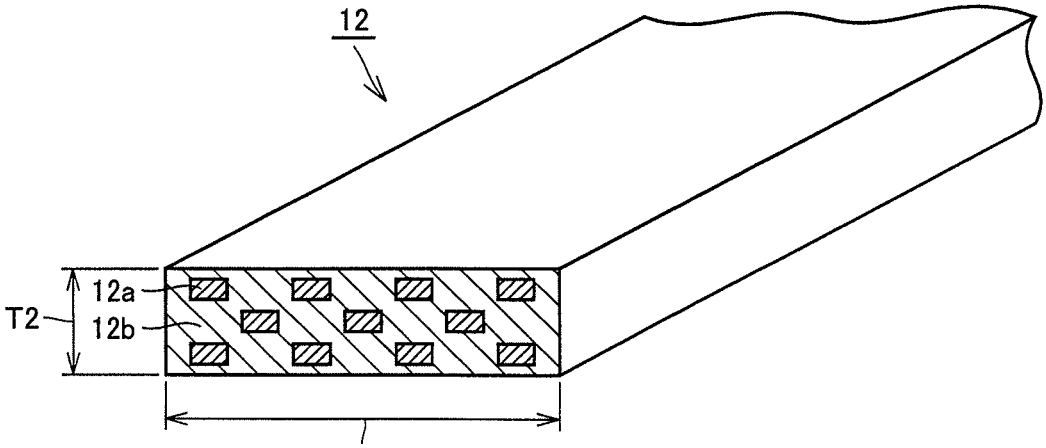
FIG. 6 is a perspective cross-sectional view of a second superconducting wire used in the superconducting coil in FIG. 1.

Referring mainly to FIGS. 5 and 6, first and second superconducting wires 11, 12 have thicknesses T1 and T2, respectively. Though each of thicknesses T1 and T2 is close approximately to a dimension T (an approximate dimension per one layer in a stack of superconducting wires obtained by winding of the superconducting wires in FIG. 1), thickness T1 is greater than thickness T2. Namely, second superconducting wire 12 is smaller in thickness than first superconducting wire 11. For example, dimension T is approximately from 0.2 to 0.4 mm, and a difference between thicknesses T1 and T2 is approximately from 0.1 to 0.2 mm.

In addition, first superconducting wire 11 is higher in strength than second superconducting wire 12. It is noted that "strength" herein refers to tensile strength and bending strength. Therefore, superconducting wire 11 is higher in tensile strength and bending strength than second superconducting wire 12. Tensile strength is measured, for example, as a value of tensile stress at which a critical current through a superconducting wire lowers to 95%, and a greater value thereof indicates higher strength. Bending strength is measured, for example, as a diameter of curvature at which a critical current through a superconducting wire lowers to 95%, and a smaller value thereof indicates higher strength. For example, first superconducting wire 11 has tensile strength of 270 MPa, second superconducting wire 12 has tensile strength of 130 MPa, first superconducting wire 11 has bending strength of 60 mm, and second superconducting wire 12 has bending strength of 70 mm.

First and second superconducting wires 11, 12 have widths W1 and W2, respectively. Each of widths W1 and W2 is close approximately to a dimension W (an approximate dimension of superconducting coil 80 in a direction of axis of winding in FIG. 1). Width W1 is greater than width W2, and hence there is a height difference D (FIG. 2) between inner circumferential portion 73 and outer circumferential portion 75. For example, dimension W is approximately from 4 to 5 mm, and a difference between widths W1 and W2 is approximately 0.2 mm.

Specifically, in the present embodiment, first superconducting wire 11 is formed by sandwiching a wire similar to second superconducting wire 12 between a pair of lamination portions 11*a* in a direction of thickness. With this structure, thickness T1 is greater than thickness T2, and first superconducting wire 11 is higher in strength than second superconducting wire 12. Lamination portion 11*a* is made, for example, of stainless steel. The pair of lamination portions 11*a* is joined with a pair of soldering portions 11*b* being interposed therebetween. The pair of soldering portions 11*b* sandwiches a wire similar to first superconducting wire 12 in a direction of width. With this structure, width W1 is greater than width W2.

Second superconducting wire 12 may be, for example, a bismuth (Bi)-based superconducting wire. Specifically, second superconducting wire 12 has a plurality of superconductors 12*a* extending in a longitudinal direction and a sheath portion 12*b* covering the entire perimeter of the plurality of superconductors 12*a*. Sheath portion 12*b* is in contact with superconductor 12*a*. Each of the plurality of superconductors 12*a* is preferably a bismuth-based superconductor having, for example, Bi—Pb—Sr—Ca—Cu—O-based composition, and in particular, a material containing such a Bi 2223 phase that an atomic ratio among bismuth and lead:strontium:calcium:copper is represented in an approximated manner by substantially a ratio of 2:2:2:3 is optimal. A material for sheath portion 12*b* is made, for example, of silver or a silver alloy. It is noted that a single superconductor 12*a* may be provided.

A method for manufacturing superconducting coil 80 will now be described.

Figure 7:
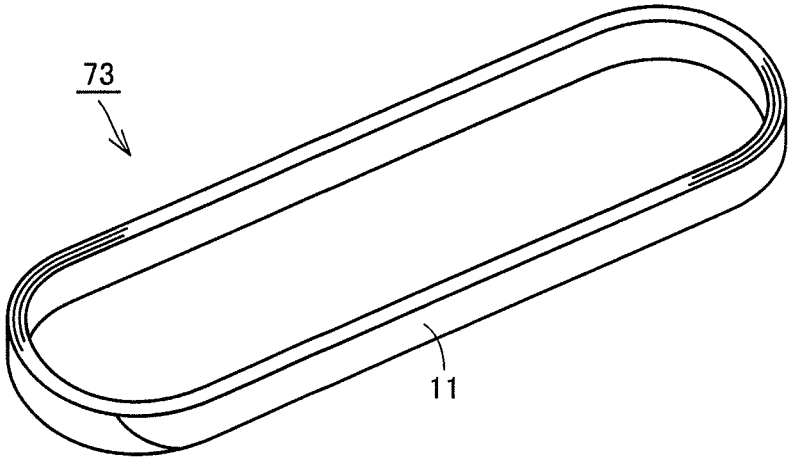
FIG. 7 is a perspective view schematically showing a first step in a method for manufacturing a superconducting coil in the first embodiment of the present invention.

Referring to FIG. 7, initially, inner circumferential portion 73 is foamed by winding first superconducting wire 11.

Figure 8:
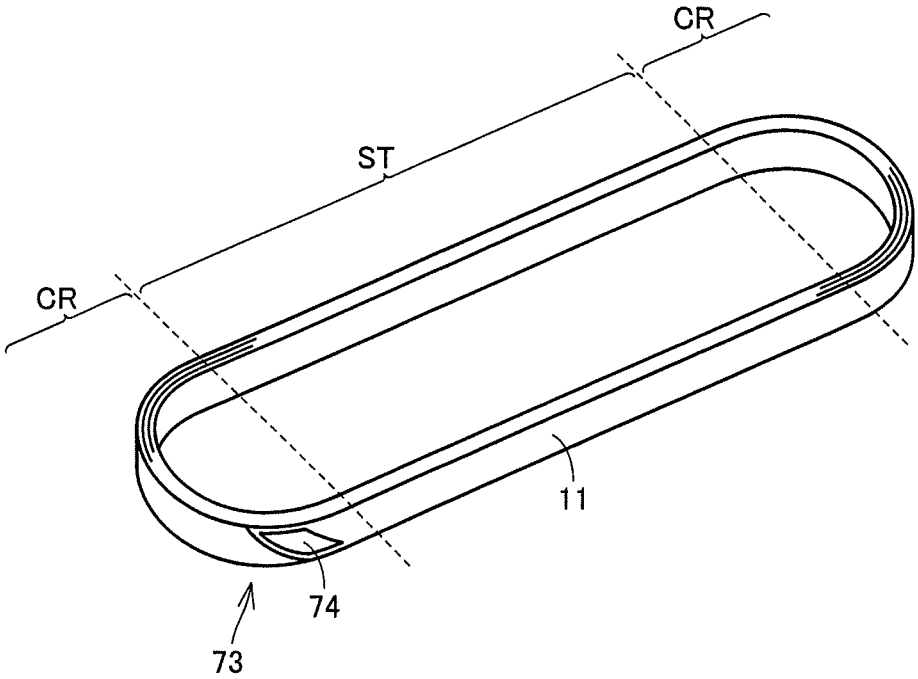
FIG. 8 is a perspective view schematically showing a second step in the method for manufacturing a superconducting coil in the first embodiment of the present invention.

Referring to FIG. 8, welding portion 74 is formed at an end portion of first superconducting wire 11 exposed at an outer circumferential surface of inner circumferential portion 73. Welding portion 74 is specifically formed of a brazing alloy and preferably formed of solder.

Figure 9:
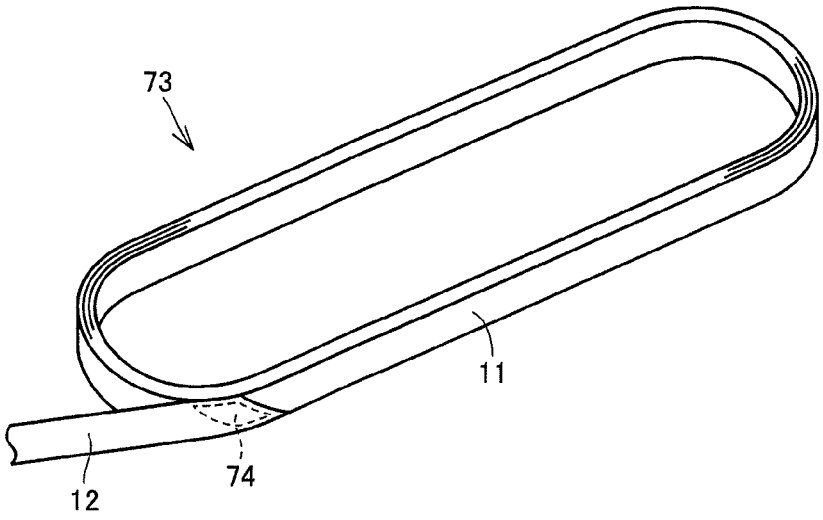
FIG. 9 is a perspective view schematically showing a third step in the method for manufacturing a superconducting coil in the first embodiment of the present invention.

Referring to FIG. 9, first and second superconducting wires 11, 12 are joined to each other by welding with welding portion 74. Specifically, welding portion 74 is heated while an end portion of second superconducting wire 12 is in contact with welding portion 74.

It is noted that, in order to avoid displacement of the end portion of the first superconducting wire where welding portion 74 has been formed during this joint, this end portion is preferably fixed to inner circumferential portion 73 in advance. This fixation can be achieved, for example, by using a polyimide tape.

By winding second superconducting wire 12 around inner circumferential portion 73 after first and second superconducting wires 11, 12 are joined as above, outer circumferential portion 75 is formed. In winding second superconducting wire 12, tensile force is applied to second superconducting wire 12 in a longitudinal direction thereof. In a case where welding portion 74 is located at curved portion CR, this tensile force applies inward force to welding portion 74. Therefore, superconducting wire 10 in the vicinity of welding portion 74 is wound with less loosening.

As above, superconducting coil 80 (FIG. 1) is obtained.

According to superconducting coil 80 in the present embodiment, of inner circumferential portion 73 and outer circumferential portion 75, one requiring higher strength can be formed from first superconducting wire 11, while one requiring lower strength can be formed from second superconducting wire 12. Namely, a portion requiring higher strength can be formed from a superconducting wire higher in strength, while a portion requiring lower strength can be formed from a superconducting wire smaller in thickness. Consequently, an average value of dimension T (FIG. 1) is smaller than in a case where strength of superconducting wire 10 is increased over the entire length. Thus, in superconducting coil 80 having a prescribed number of turns, reduction in size of superconducting coil 80 in a plan view (FIG. 4) can be achieved while high reliability is ensured.

More specifically, inner circumferential portion 73 is formed by winding first superconducting wire 11, and outer circumferential portion 75 is formed by winding second superconducting wire 12. Thus, inner circumferential portion 73 wound at a diameter of curvature smaller than that of outer circumferential portion 75 is formed from a superconducting wire higher in strength. Therefore, damage of a superconducting wire due to a small diameter of curvature can be suppressed.

Figure 10:
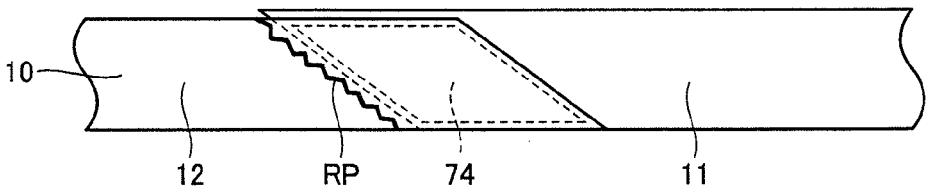
FIG. 10 is a plan view showing one example of rupture caused in the second superconducting wire in the vicinity of the welding portion between the first and second superconducting wires.

In a case where at least a part of welding portion 74 is located at curved portion CR, winding with less loosening is achieved during manufacturing of superconducting coil 80 because at least a part of welding portion 74 is located at curved portion CR. Therefore, since a position of welding portion 74 is stabilized, welding portion 74 is less likely to displace during manufacturing of superconducting coil 80. Thus, second superconducting wire 12, that is, a superconducting wire smaller in thickness, can be prevented from being damaged (such as rupture RP in FIG. 10) at an end portion of welding portion 74 due to displacement of welding portion 74.

In a case where welding portion 74 is located only at curved portion CR, welding portion 74 is not provided at straight portion ST where loosening is likely during manufacturing of superconducting coil 80. Therefore, since a position of welding portion 74 is further stabilized, welding portion 74 is further less likely to displace during manufacturing of superconducting coil 80. Thus, second superconducting wire 12, that is, a superconducting wire smaller in thickness, can further be prevented from being damaged at an end portion of welding portion 74 due to displacement of welding portion 74. Alternatively, if welding portion 74 is located across straight portion ST and curved portion CR, during manufacturing of superconducting coil 80, a portion of welding portion 74 located at curved portion CR is less likely to displace as described above, while a portion located at straight portion ST is likely to displace. Consequently, the welding portion tends to deteriorate at a boundary between straight portion ST and curved portion CR. Such deterioration can be prevented by welding portion 74 located only at curved portion CR.

In a case where welding portion 74 has a length not shorter than 2 cm in superconducting coil 80 above, welding portion 74 can have electrical resistance of a value sufficiently small in terms of practical use.

According to the method for manufacturing superconducting coil 80 in the present embodiment, welding portion 74 is formed after inner circumferential portion 73 is formed. Therefore, unlike a case where inner circumferential portion 73 is wound after first and second superconducting wires 11, 12 are joined to each other with welding portion 74, damage of a superconducting wire, in particular rupture RP (FIG. 10), attributed to welding portion 74 is unlikely during formation of inner circumferential portion 73.

Though first superconducting wire 11 is employed for inner circumferential portion 73 and second superconducting wire 12 is employed for outer circumferential portion 75 in the present embodiment, in a case where reliability of outer circumferential portion 75 is particularly demanded, first superconducting wire 11 may be employed for outer circumferential portion 75 and second superconducting wire 12 may be employed for inner circumferential portion 73. In addition, width W1 of first superconducting wire 11 does not necessarily have to be greater than width W2 of the second superconducting wire. Moreover, a superconducting coil does not necessarily have to be in a racetrack shape, and the shape may be circular or polygonal.

Second Embodiment

Figure 11:
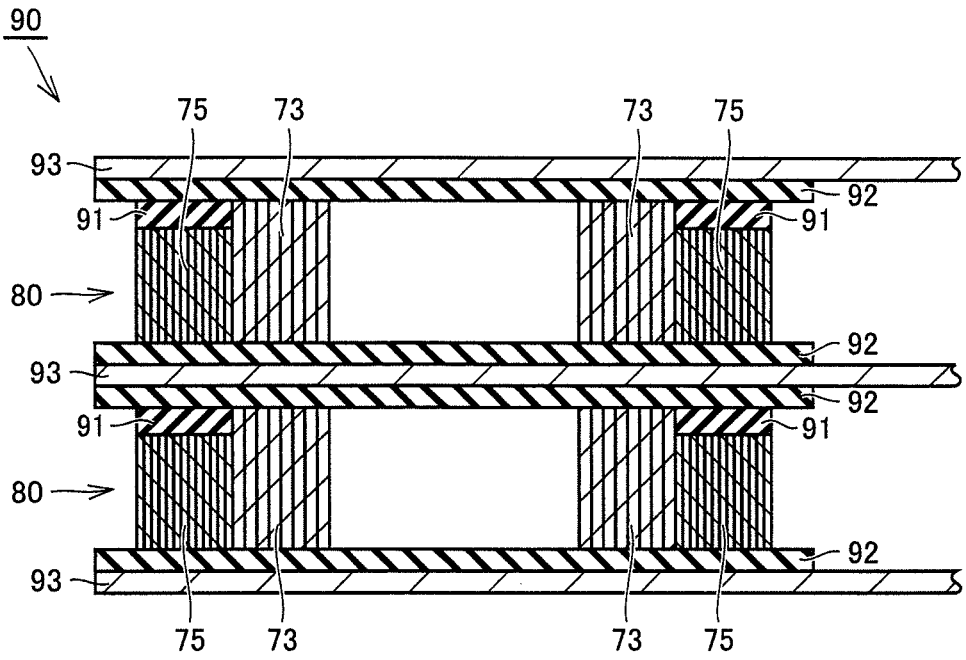
FIG. 11 is a partial cross-sectional view schematically showing a superconducting coil in a second embodiment of the present invention.

Referring to FIG. 11, a superconducting coil 90 in the present embodiment has a plurality of superconducting coils 80 according to the first embodiment, a spacer portion 91, an insulating plate 92, and a cooling plate 93.

Figure 2:
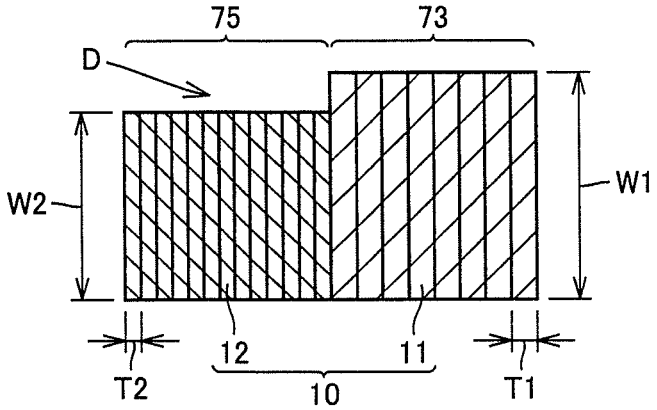
FIG. 2 is a schematic cross-sectional view along the line II-II in FIG. 1.
Figure 3:
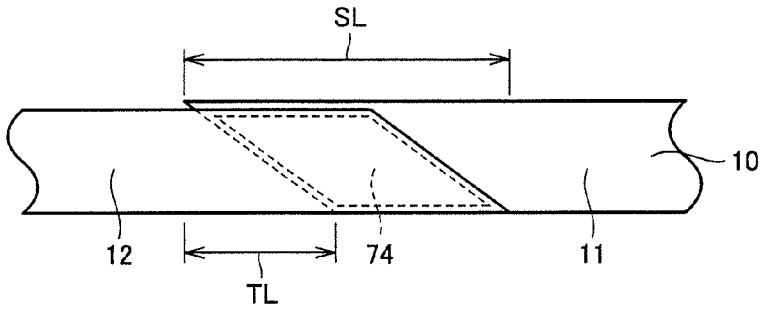
FIG. 3 is a plan view schematically showing a portion in the vicinity of a welding portion between first and second superconducting wires used in the superconducting coil in FIG. 1.

Spacer portion 91 is a spacer burying at least a part of height difference D (FIG. 2). Preferably, a height of spacer portion 91 (a vertical dimension in FIG. 11) is equal to height difference D (a vertical dimension in FIG. 2). Namely, preferably, a height of the spacer portion is equal to a difference between width W1 and width W2.

Spacer portion 91 is preferably formed from a sheet made of an insulator, and specifically, it is formed from a prepreg sheet or an FRP (Fiber Reinforced Plastic) sheet.

Cooling plates 93 are arranged to sandwich each superconducting coil 80. Cooling plate 93 serves to thermally connect superconducting coil 80 to a refrigerator head (not shown). Insulating plate 92 is inserted between cooling plate 93 and superconducting coil 80. The plurality of superconducting coils 80 are stacked in a direction of axis of winding with cooling plate 93 and insulating plate 92 being interposed therebetween.

According to the present embodiment, spacer portion 91 can bury a gap created by height difference D. Therefore, lowering in heat conduction caused by this gap (such as lowering in heat conduction between outer circumferential portion 75 and cooling plate 93) can be suppressed.

In addition, in a case where a material for spacer portion 91 is a prepreg sheet or FRP, a difference in coefficient of thermal expansion between spacer portion 91 and superconducting wire 10 can be decreased.

It is noted that, in a case where a superconducting coil is directly cooled by such a fluid as liquid nitrogen, it is not necessary to provide cooling plate 93.

Third Embodiment

Figure 12:
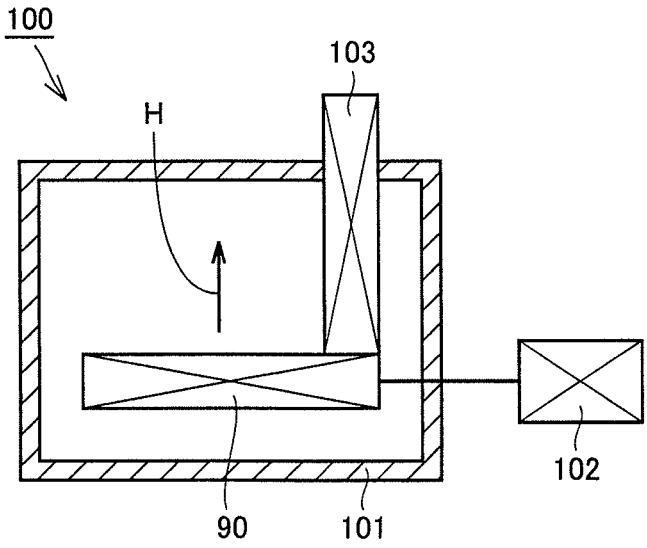
FIG. 12 is a cross-sectional view schematically showing a superconducting magnet in a third embodiment of the present invention.

Referring to FIG. 12, a superconducting magnet 100 in the present embodiment serves to generate magnetic field H, and has superconducting coil 90 (FIG. 11), a heat insulating container 101, a power supply 102, and a refrigerator head 103. Heat insulating container 101 accommodates superconducting coil 90. Power supply 102 is connected to superconducting coil 90.

According to superconducting magnet 100 in the present embodiment, of inner circumferential portion 73 and outer circumferential portion 75 (FIG. 11) of superconducting coil 90, one requiring higher strength can be formed from first superconducting wire 11 (FIG. 5), while one requiring lower strength can be formed from second superconducting wire 12 (FIG. 6). Namely, a portion requiring higher strength can be formed from a superconducting wire higher in strength, while a portion requiring lower strength can be formed from a superconducting wire smaller in thickness. Therefore, in superconducting magnet 100 having superconducting coil 90 having a prescribed number of turns, while strength required of superconducting coil 90 can be ensured, superconducting coil 90 can be reduced in size by employing a superconducting wire smaller in thickness. Thus, superconducting magnet 100 can be reduced in size while reliability of superconducting magnet 100 is ensured.

It is noted that, instead of providing refrigerator head 103, a low-temperature fluid such as liquid nitrogen may be used.

Fourth Embodiment

Figure 13:
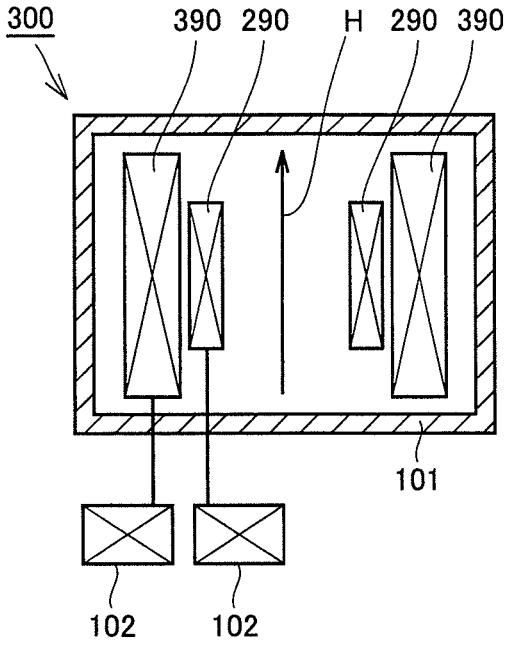
FIG. 13 is a cross-sectional view schematically showing a superconducting magnet in a fourth embodiment of the present invention.

Referring to FIG. 13, a superconducting magnet 300 in the present embodiment has superconducting coils 290 and 390. Superconducting coil 390 has a cylindrical shape and generates substantially uniform magnetic field H in the inside thereof. Superconducting coil 390 is formed, for example, by winding a superconducting wire made of NbTi. Superconducting coil 290 is arranged such that superconducting coil 290 in its entirety receives magnetic field H generated by superconducting coil 390.

Figure 14:
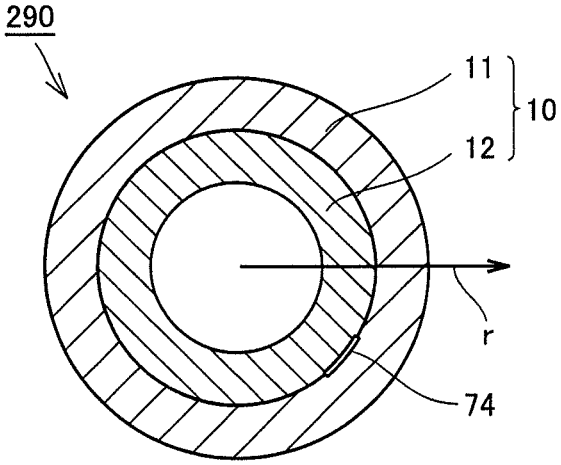
FIG. 14 is a cross-sectional view schematically showing a structure of a superconducting coil included in the superconducting magnet in FIG. 13.

Referring to FIG. 14, superconducting coil 290 is formed by annularly winding superconducting wire 10. Specifically, superconducting coil 290 has an inner circumferential portion formed by winding second superconducting wire 12 (FIG. 6) and an outer circumferential portion formed by winding first superconducting wire 11 (FIG. 5).

It is noted that, since features other than the above are substantially the same as those in the third embodiment described above, the same or corresponding elements have the same reference characters allotted and description thereof will not be repeated.

Hoop stress is applied to superconducting wire 10 of superconducting coil 290 by magnetic field H generated by superconducting coil 390. Hoop stress becomes greater in proportion to a distance r from the center of winding. Therefore, if a superconducting coil is formed simply by winding one type of superconducting wire, hoop stress applied to the outer circumferential portion is greater than hoop stress applied to the inner circumferential portion.

According to the present embodiment, the inner circumferential portion is formed from second superconducting wire 12 smaller in thickness. As such, while superconducting coil 290 is reduced in size, the outer circumferential portion to which great hoop stress is likely to be applied is formed from first superconducting wire 11 higher in strength. Thus, lowering in reliability attributed to hoop stress can be suppressed.

EXAMPLES

Hoop stress applied to superconducting wire 10 forming superconducting coil 290 (FIG. 14) included in superconducting magnet 300 (FIG. 13) was simulated.

Simulation conditions are as follows. A superconducting wire having width W1=4.5 mm, thickness T1=0.30 mm, tensile strength of 270 MPa, and bending strength of 60 mm was employed as first superconducting wire 11 (FIG. 5). A superconducting wire having width W2=4.3 mm, thickness T2=0.23 mm, tensile strength of 130 MPa, and bending strength of 70 mm was employed as second superconducting wire 12 (FIG. 6). In superconducting coil 290, second superconducting wire 12 was applied to the inner circumferential portion of which distance r from the axis was from 50 to 75 mm, and first superconducting wire 11 was applied to the outer circumferential portion of which distance r was from 75 to 100 mm. A current which flowed through superconducting coil 290 was set to 200 A. Magnetic field H generated by superconducting coil 390 was set to 8 T.

As a result of calculation, hoop stress applied to second superconducting wire 12 forming the inner circumferential portion of superconducting coil 29 was 81 MPa at the innermost portion (r=50 mm) and 121 MPa at the outermost portion (r=75 mm). These stresses were within the range of tensile strength of 130 MPa of second superconducting wire 12.

In addition, hoop stress applied to first superconducting wire 11 forming the outer circumferential portion of superconducting coil 29 was 89 MPa at the innermost portion (r=75 mm) and 119 MPa at the outermost portion (r=100 mm). These stresses were within the range of tensile strength of 270 MPa of first superconducting wire 12.

It should be understood that the embodiments and the example disclosed herein are illustrative and non-restrictive in every respect. The scope of the present invention is defined by the terms of the claims, rather than the embodiments above, and is intended to include any modifications within the scope and meaning equivalent to the terms of the claims.

REFERENCE SIGNS LIST

10 superconducting wire; 11 first superconducting wire; 12 second superconducting wire; 73 inner circumferential portion; 74 welding portion; 75 outer circumferential portion; 80, 90 superconducting coil; 91 spacer portion; 92 insulating plate; 93 cooling plate; 100 superconducting magnet; 101 heat insulating container; 102 power supply; 103 refrigerator head; CR curved portion; and D height difference.

The invention claimed is:

1. A superconducting coil having an oxide superconductor, comprising:

an inner circumferential portion formed by winding one of first and second superconducting wires each having a band shape;

an outer circumferential portion formed by winding the other of said first and second superconducting wires around said inner circumferential portion; and a welding portion joining said first and second superconducting wires to each other by welding between said inner circumferential portion and said outer circumferential portion, said first superconducting wire being higher in strength than said second superconducting wire, and said second superconducting wire being smaller in thickness than said first superconducting wire, and the entire circumference of said outer circumferential portion is positioned outside said inner circumferential portion viewed from a winding axis of said first and second superconducting wires.

2. The superconducting coil according to claim 1, wherein said inner circumferential portion is formed by winding said first superconducting wire, and said outer circumferential portion is formed by winding said second superconducting wire.

3. The superconducting coil according to claim 1, wherein said first and second superconducting wires joined to each other by said welding portion are wound to form a racetrack shape having a straight portion and a curved portion, and at least a part of said welding portion is located at said curved portion.

4. The superconducting coil according to claim 3, wherein said welding portion is located only at said curved portion.

5. The superconducting coil according to claim 1, wherein said welding portion has a length not shorter than 2 cm.

6. The superconducting coil according to claim 1, wherein there is a height difference between said inner circumferential portion and said outer circumferential portion because a width of the band shape of said first superconducting wire is greater than a width of the band shape of said second superconducting wire, and said superconducting coil further comprises a spacer portion burying said height difference.

7. A superconducting magnet, comprising:

the superconducting coil according to claim 1;

a heat insulating container accommodating said superconducting coil; and a power supply connected to said superconducting coil.

* * * * *